US005279358A

United States Patent [19]

Hannis

[11] Patent Number: 5,279,358

[45] Date of Patent: Jan. 18, 1994

[54] GAS TURBINE EXHAUST SYSTEM

[75] Inventor: John M. Hannis, Lincoln, England

[73] Assignee: European Gas Turbines Limited, England

[21] Appl. No.: 948,674

[22] Filed: Sep. 21, 1992

[30] Foreign Application Priority Data

Oct. 23, 1991 [GB] United Kingdom ..... 9122440.2

[51] Int. Cl.[5] ..... F28F 27/02; F02C 7/08

[52] U.S. Cl. ..... 165/103; 60/39.5; 137/862

[58] Field of Search ..... 165/103, 35-38; 60/39.5, 39.511, 694, 697; 137/872, 876, 862

[56] References Cited

U.S. PATENT DOCUMENTS

| | | | |
|---|---|---|---|
| 2,856,957 | 10/1958 | McDowall et al. | 137/528 |
| 2,994,193 | 8/1961 | Friedmann | 137/862 |
| 3,208,510 | 9/1965 | Ohnoda et al. | 165/103 |
| 4,748,805 | 6/1988 | Rigault et al. | 60/39.5 |
| 4,785,624 | 11/1988 | Smith et al. | 60/39.75 |
| 5,002,121 | 3/1991 | Von Erichsen | 165/103 |
| 5,004,044 | 4/1991 | Horgan et al. | 60/39.511 |

FOREIGN PATENT DOCUMENTS

| | | | |
|---|---|---|---|
| 0276448 | 8/1988 | European Pat. Off. . | |
| 1035977 | 8/1958 | Fed. Rep. of Germany . | |
| 2733931 | 2/1979 | Fed. Rep. of Germany . | |
| 2926366 | 1/1981 | Fed. Rep. of Germany . | |
| 1371857 | 8/1964 | France | 165/103 |
| 721459 | 1/1955 | United Kingdom . | |
| 772247 | 4/1957 | United Kingdom . | |
| 0905262 | 9/1962 | United Kingdom . | |
| 9005238 | 5/1990 | World Int. Prop. O. . | |

OTHER PUBLICATIONS

Patent Abstracts of Japan, vol. 14, No. 416 (M-1021) (4359) Sep. 7, 1990.

*Primary Examiner*—John Rivell
*Assistant Examiner*—L. R. Leo
*Attorney, Agent, or Firm*—Kirschstein, Ottinger, Israel and Schiffmiller

[57] ABSTRACT

An exhaust system for a gas turbine has a main axial duct which feeds a heat exchanger to make use of the residual heat in the exhaust gases. The heat exchanger may in some circumstances be overloaded so a branch duct is taken from the main duct conventionally by means of a T-junction with a flap valve closing off either the main (axial) outlet or the branch outlet. The branch duct is then taken to an exhaust stack. Turbulence at the T-junction causes poor flow upstream of the junction and corresponding poor turbine performance. The invention provides a junction in which the main axial duct (1) passes smoothly through a bypass chamber (15) which surrounds the axial duct (1). Slots (17) in the axial duct within the chamber (15) permit passage of the exhaust gases to the bypass duct (19). Rotating blade valves (13 and 23) in the two duct outlets control the relative flow of exhaust to heat exchanger and exhaust stack.

11 Claims, 2 Drawing Sheets

GAS TURBINE EXHAUST SYSTEM

BACKGROUND OF THE INVENTION

1. Field of the Invention

This invention relates to exhaust systems for gas turbine engines in which a considerable amount of energy is present in the exhaust gas. This energy, largely heat, may be usefully employed, for example in combined heat and power systems. In such a system the engine is used as a prime mover to generate electricity and the exhaust gas is passed through a heat exchanger to generate steam or to recover otherwise heat energy from the exhaust gas.

2. Description of the Related Art

It is often a requirement in such systems that the production of steam is controllable by the amount of hot exhaust gas allowed through the heat exchanger, surplus gas being diverted through a bypass arrangement to atmosphere by way of a stack.

Conventional bypass arrangements commonly employ a main duct and a bypass duct branching from it at right angles. A valve at the branch either allows the exhaust gas to proceed axially along the main duct or diverts some or all of it to the bypass duct. This diversion of the exhaust gas causes considerable disturbance of the flow and the resultant adverse forces generated can degrade turbine peformance and may even cause premature turbine blade or ducting failure.

Such repercussions of flow disturbance on turbine performance can be alleviated at least partially by increasing the length of the duct sections, particularly between the engine outlet and the bypass section. Such increase in overall dimensions is not always possible and is in any event undesirable.

SUMMARY OF THE INVENTION

An object of the present invention is therefore to provide a compact gas turbine exhaust system with a controllable bypass while permitting good exhaust gas flow.

According to the present invention, a gas turbine exhaust system comprises a straight duct section having an axial inlet for receiving exhaust gas from a gas turbine and an axial outlet for expelling exhaust gas to a heat exchanger, a chamber surrounding the duct section and being sealed to it, the duct section being vented into the chamber at multiple positions around the periphery of the duct section, and the chamber having an outlet transverse to the duct section axis for feeding a path which bypasses the heat exchanger, and valve means adapted to control the relative exhaust gas flows to the axial outlet and the chamber outlet.

There may be a multiplicity of slots in the wall of the section whereby venting of the duct section into the chamber is dispersed around the periphery. The slots are preferably uniformly spaced around the periphery of the duct section and extend parallel to the axis of the duct section.

The axial outlet and the chamber outlet may have respective damper sections controllable to direct exhaust gas through the axial outlet and the chamber outlet selectively. Means may be provided to link the control of the damper sections.

Alternatively, a cylindrical shutter may be mounted to enclose the duct section, the shutter having apertures which can be aligned with the slots or offset from the slots selectively. In this case the apertures may be of approximately triangular form and arranged so that rotation of the shutter in one direction exposes an increasing length of each of the slots.

The axial outlet may have a damper section controllable in conjunction with said shutter to direct exhaust gas through the axial outlet and the chamber outlet selectively.

The duct section is preferably of circular section, and the chamber at least partially of circular section.

The duct section and the chamber may be concentric or the centre of the duct section may be offset from the centre of the chamber in a direction away from the chamber outlet, the arrangement being such that the uniformity of velocity of exhaust gas flow through the chamber is improved.

The axial outlet of the straight duct section preferably includes a splitter section immediately downstream of the chamber, the splitter section comprising a plurality of partitions aligned with the gas flow path and adapted to suppress flow disturbance arising from the axial outlet damper section.

BRIEF DESCRIPTION OF THE DRAWINGS

One embodiment of a gas turbine exhaust system in accordance with the invention, will now be described, by way of example, with reference to the accompanying drawings, of which:

FIG. 3(*b*) is a broken-away view of a modified shutter device; and

DETAILED DESCRIPTION OF THE PREFERRED EMBODIMENTS

Figure 2:
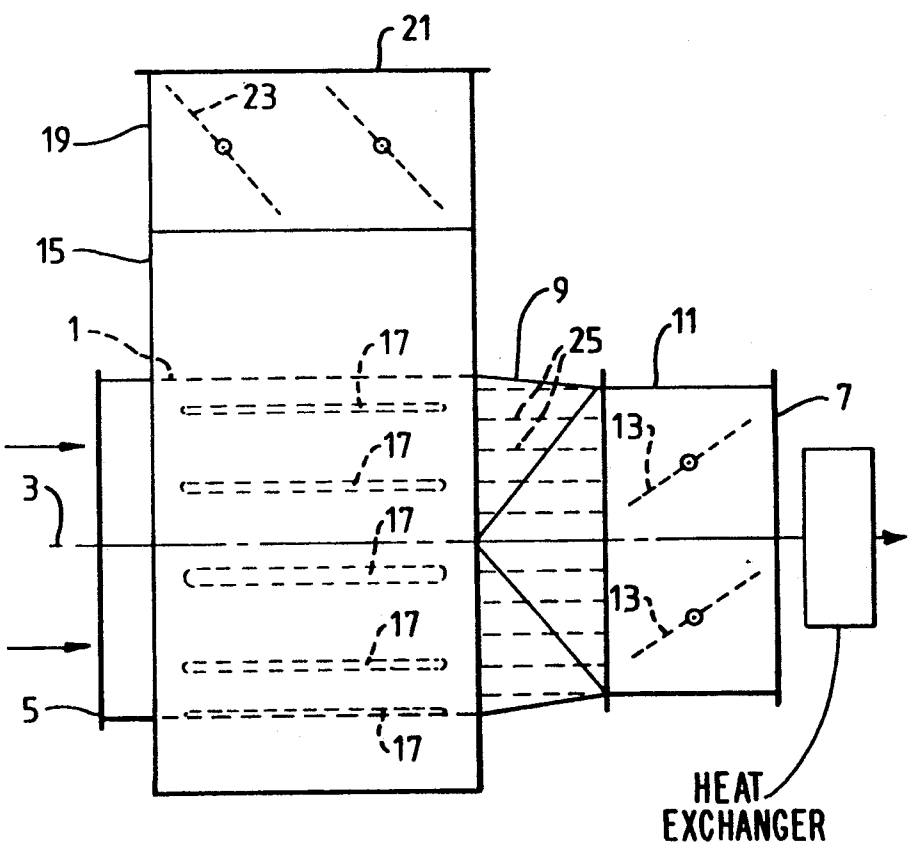
FIGS. 1, 2 and 3(*a*) are end view, front elevation, and plan respectively of an exhaust gas bypass section.

Referring to the drawings, the main exhaust section comprises a straight duct section 1 of circular cross section having an axis 3. This duct section has an inlet flange 5 and an axial outlet 7, the direction of flow being shown by the arrow. The circular section terminates in a circular-to-square transition section 9, followed by a damper section 11 having rotatable blade (13) valves in the square damper section.

Surrounding the circular duct section 1 is a chamber 15 which is sealed to the duct 1 so as to enclose a volume external to the duct 1. The duct 1 is vented into this chamber by means of eleven slots 17 in the duct wall extending parallel to the axis 3. The slots have a length approximately 80% of the duct diameter, a width about 7% of the duct diameter, are distributed uniformly around the periphery of the duct and are aligned lengthways with the duct axis.

Figure 3A:
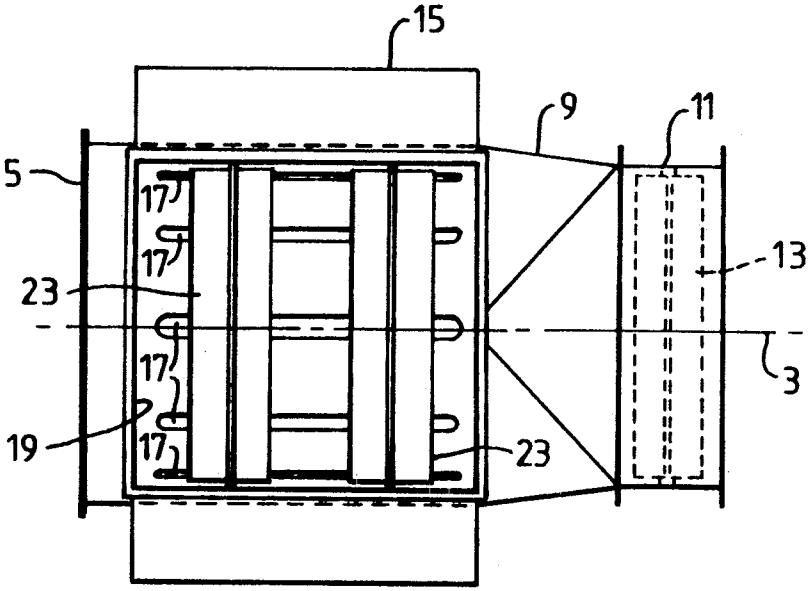
Figure 3B:
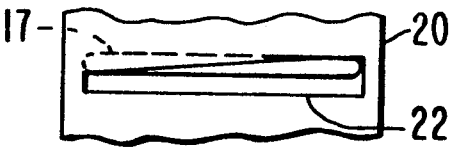

The chamber 15 converges, in a direction transverse to the axis 3, to a square damper section 19 as shown in FIG. 3(*a*) in plan view. The chamber outlet (at flange 21) is thus controlled by the damper blades 23.

In operation, the bypass valves 23 would normally be closed while the heat exchanger connected to the axial outlet 7 can accept all the heat provided. When the load on the heat exchanger is small and the heat applied to it is not being dissipated, temperature sensors and control devices (not shown) are effective to close the valves of the damper section 11 and open those of the bypass damper section 19. These operations would be made in synchronism so as to disturb the overall exhaust flow from the gas turbine as little as possible. The extent to which the valves 13 and 23 are closed and opened respectively would be controlled according to the demand of the heat exchanger.

The venting of the exhaust gas from the main (axial ) duct 1 to the chamber 15 through the slots 17 is found to reduce flow disturbance upstream of the bypass section and thus cause little deterioration in the turbine performance. The choice of slot number, eleven, also contributes to the suppression of damaging resonances in the turbine. This effect is further assisted by the prime nature of the slot number. Such features will however, vary from one installation to another.

In the transition section 9, immediately downstream of the chamber 15, a set of partition plates or 'splitters' 25 are mounted to assist in streamlining the flow. These splitters are linear, extending across the transition section 9 in planes to which the bypass axis is perpendicular.

It is found that these splitter plates are effective in conditions of partial main flow and partial bypass to attenuate upstream flow disturbance. The splitter plates are therefore an optional feature for inclusion according to the known or expected operating conditions.

Figure 1:
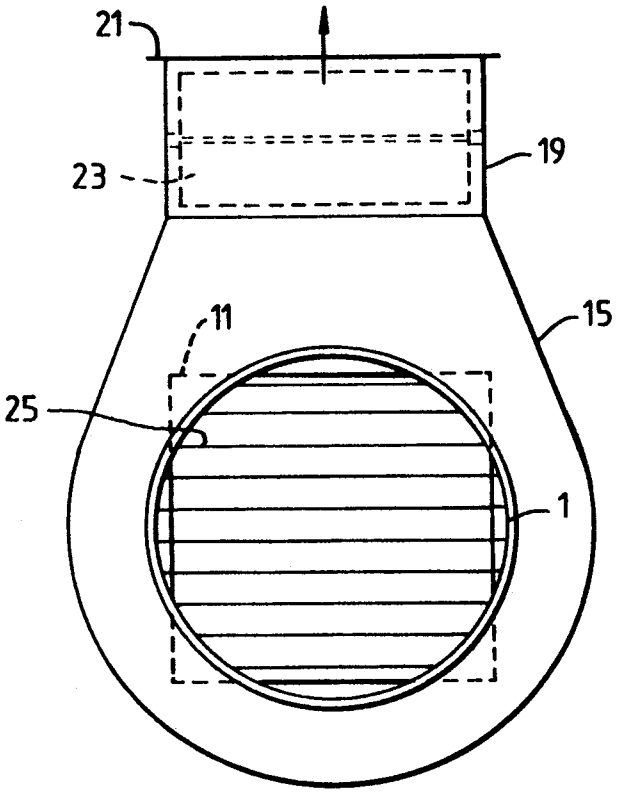

As an alternative to the bypass valve section 19, a shutter device may be used directly cooperating with the slotted duct 1. One such arrangement may comprise a shutter in the form of a cylinder 20 (shown in part in FIG. 3(*b*) enclosing the slotted area of the duct 1 and rotatable on it. The shutter has a series of triangular apertures 22, one for each slot. The shutter can be rotated so that each of the slots 17 is completely exposed (open), completely closed, or partly open (as shown in FIG. 3(*b*)) according to the alignment of aperture and slot. Such a shutter is operated by a lever mechanism in synchronism with main outlet valves 13. This arrangement will improve the uniformity of flow velocity across the chamber outlet duct as seen in FIG. 1 when the dampers are partly open.

It will be clear that the slots 17 need not be arranged longitudinally as shown: they could be angled to the axis. In such a design the above apertures could be rectangular.

Figure 4:
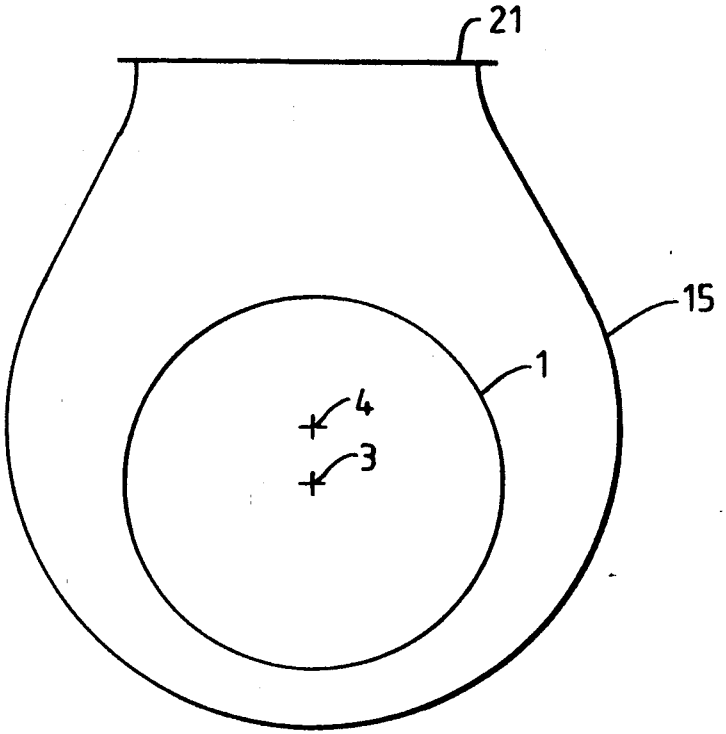
FIG. 4 is an end view of a modified bypass section.

A modification of the chamber arrangment relative to the main duct 1 is shown in FIG. 4. The duct 1 axis 3 is offset from the chamber axis 4 by about one-sixth of the duct diameter, in a direction away from the chamber outlet 21. This offset arrangement is found to give a more uniform flow velocity within the chamber 15.

I claim:

1. A gas turbine exhaust system, comprising:

(A) a straight duct section having (i) an axial inlet for receiving exhaust gas from a gas turbine, and (ii) an axial outlet for expelling exhaust gas to a heat exchanger;

(B) a chamber surrounding, and being sealed to said duct section, (i) said duct section being vented into said chamber by a multiplicity of slots in a wall of said duct section at positions around the periphery of said duct section, and (ii) said chamber having an outlet transverse to an axis of said duct section for feeding a path which bypasses said heat exchanger;

(C) valve means for controlling the relative exhaust gas flows to said axial outlet and said chamber outlet; and (D) said valve means comprising respective damper sections in said axial outlet and said chamber outlet, said damper sections being controllable in synchronism with each other to direct exhaust gas through said axial outlet and said chamber outlet in controlled proportions.

2. An exhaust system according to claim 1, wherein said slots are uniformly spaced around the periphery of the duct section and extend parallel to the axis of the duct section.

3. An exhaust system according to claim 1, wherein said duct section is of circular section, and said chamber is at least partially of circular section.

4. An exhaust system according to claim 3, wherein the center of said duct section is offset from the center of said chamber in a direction away from said chamber outlet, thereby improving the uniformity of velocity of exhaust gas flow through said chamber.

5. An exhaust system according to claim 1, wherein said axial outlet of the straight duct section includes a splitter section immediately downstream of said chamber, said splitter section comprising a plurality of partitions aligned with the gas flow path and adapted to suppress flow disturbance arising from the axial outlet damper section.

6. A gas turbine exhaust system, comprising:

(A) a straight duct section having (i) an axial inlet for receiving exhaust gas to a heat exchanger;

(B) a chamber surrounding, and being sealed to, said duct section, (i) said duct section being vented into said chamber by a multiplicity of slots in a wall of the duct section at positions around the periphery of the duct section, and (ii) said chamber having an outlet transverse to an axis of said duct section for feeding a path which bypasses said heat exchanger;

(C) valve means for controlling the relative exhaust gas flows to said axial outlet and said chamber outlet;

(D) a cylindrical shutter mounted to enclose said duct section, the shutter having apertures for selective alignment with, and offset from, said slot; and (E) said valve means comprising said cylindrical shutter in respect of said chamber outlet and a damper section in respect of said axial outlet, said shutter and said damper section being controllable in synchronism with each other to direct exhaust gas through said axial outlet and said chamber outlet in controlled proportions.

7. An exhaust system according to claim 6, wherein said slots are uniformly spaced around the periphery of the duct section and extend parallel to the axis of the duct section.

8. An exhaust system according to claim 6, wherein the apertures are of approximately triangular form and arranged so that rotation of the shutter in one direction exposes an increasing length of each of said slots.

9. An exhaust system according to claim 6, wherein said duct section is of circular section, and said chamber is at least partially of circular section.

10. An exhaust system according to claim 9, wherein the center of said duct section is offset from the center of said chamber in a direction away from said chamber outlet, thereby improving the uniformity of velocity of exhaust gas flow through said chamber.

11. An exhaust system according to claim 6, wherein said axial outlet of the straight duct section includes a splitter section immediately downstream of said chamber, said splitter section comprising a plurality of partitions aligned with the gas flow path and adapted to suppress flow disturbance arising from the axial outlet damper section.

* * * * *